United States Patent [19]

Bailey

[11] Patent Number: 5,007,312

[45] Date of Patent: Apr. 16, 1991

[54] WRENCH FOR METAL TUBING CONNECTORS

[76] Inventor: Carey G. Bailey, 2171 Shetland Rd., Livermore, Calif. 94550

[21] Appl. No.: 463,353

[22] Filed: Jan. 11, 1990

[51] Int. Cl.[5] ..... B25B 7/02

[52] U.S. Cl. ..... 81/426.5; 269/6; 269/296; 81/367

[58] Field of Search ..... 81/367–380, 81/418–423, 424.5, 426.5, 13, 487; 269/3, 6 R, 296, 110, 201, 265, 228, 270, 257–258, 271, 279–280

[56] References Cited

U.S. PATENT DOCUMENTS

| | | | |
|---|---|---|---|
| 519,550 | 5/1894 | Riordan | 81/426.5 X |
| 558,246 | 4/1896 | Wood | 81/420 X |
| 1,069,106 | 8/1913 | Brice | 81/426.5 X |
| 2,716,365 | 8/1955 | Keeley, Jr. | 81/426.5 X |
| 2,814,222 | 11/1957 | Sanders | 81/423 X |
| 4,726,266 | 2/1988 | Undin et al. | 81/367 X |
| 4,820,901 | 4/1989 | Peviani | 81/368 X |

FOREIGN PATENT DOCUMENTS

| | | | |
|---|---|---|---|
| 2462971 | 3/1981 | France | 81/124.4 |

*Primary Examiner*—D. S. Meislin

*Attorney, Agent, or Firm*—Flehr, Hohbach, Test, Albritton & Herbert

[57] ABSTRACT

A double jawed locking hand vice is provided which comprises a gripping means for securely holding a tubular member and a securing means for securing a nut of preselected size and shape against rotation with respect to the tubular piece when the tubular piece and the nut are held concentrically disposed with respect to one another within the vice.

5 Claims, 1 Drawing Sheet

WRENCH FOR METAL TUBING CONNECTORS

The present invention is directed to a double jawed locking hand device for gripping tubing and threaded tubing connectors, particularly, threaded tubing connectors for gas lines.

BACKGROUND OF THE INVENTION

Metallic tubing is used in high vacuum and/or high pressure systems for many laboratory and industrial applications. The tubing is connected to adapters, valves, and other connectors by use of vacuum-tight swaged-ends. To hold the two ends of the tubing together in a vacuumtight manner, one of the ends accommodates a female fitting and the other end accommodates a male fitting, the two of which are threaded together. These fittings rotate freely around the tubing until they are tightened.

One of the difficulties, however, in tightening the male and female fittings is that one of the fittings (usually having a hexagonal head) must be held stationary while the other fitting is tightened down with a wrench, or other suitable tool. At the same time, while the fittings are being tightened, the swaged or flared ends of the stationary tubing should be held tightly against the seal in the interior of its fittings, which requires that the stationary fitting not only be held to prevent rotational movement but also be held with a slight force in a longitudinal direction away from the open end of the tubing. Furthermore, there is the alignment which should be maintained between the tubing and the fitting which is held stationary to insure that the fitting is not tightened down with the tubing askew within the fitting, thereby increasing the risk of leaks.

Typically what is done is that one of the fittings, usually the female fitting, is held with a conventional vice grip with one hand while attempting to maintain that fitting into proper alignment into the tubing. The male fitting is then tightened down using another vice grip or wrench. This is difficult, time consuming and tedious, particularly when there are many fittings to be tightened.

It would thus be desirable to provide a tool which would allow for the simultaneous holding of the stationary fitting, and the tubing over which it is fitted in the proper position and with the proper tension to insure proper alignment and sealing, while the other fitting (typically the male fitting) is tightened with a wrench or other vice grip.

DESCRIPTION OF THE PREFERRED EMBODIMENT

The present invention provides a double jawed locking hand vice comprising a means for locking the jaws in a preselected closed position and a means for adjusting the closed position; wherein the co-facial surfaces of the jaws are adapted with grips for securely holding a tubular piece and a securing means for securing a nut of preselected size and shape against rotation with respect to the tubular piece while the tubular piece is held by the grips.

Preferably the jaws of the vice grip will be adapted with securing means for securing nuts of different preselected sizes and shapes.

Figure 1:
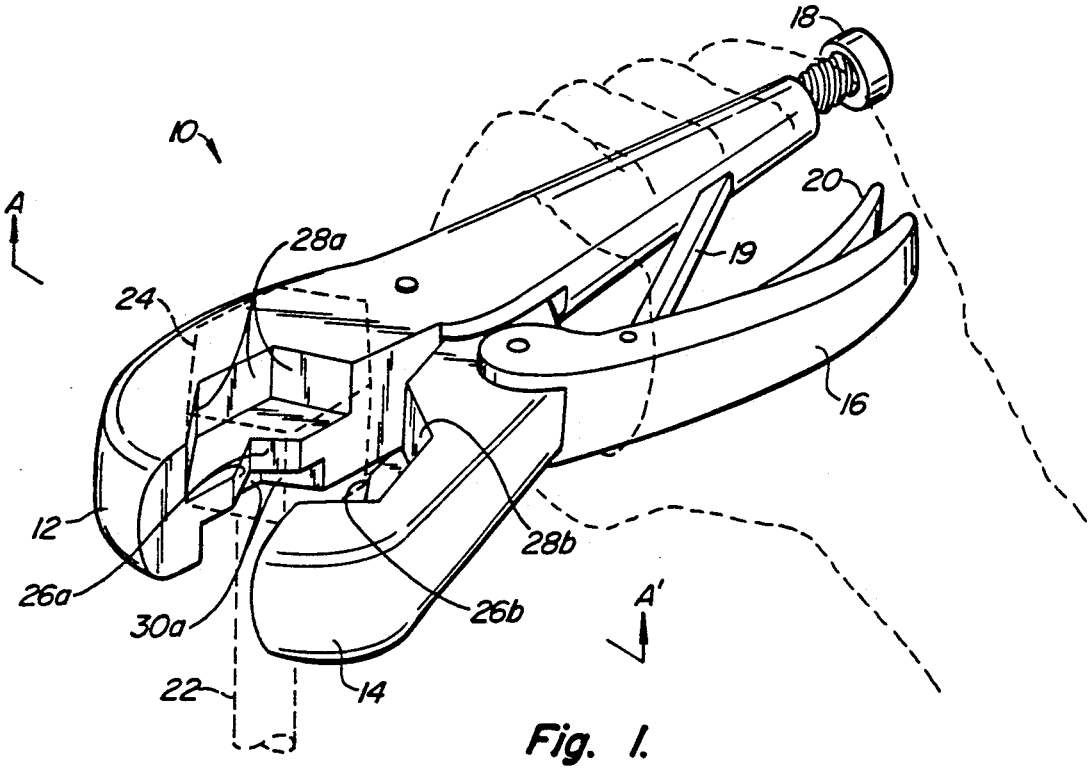
FIG. 1 is a perspective of a preferred embodiment of a double jawed locking hand vice according to the present invention. Shown (in ghost) are a users hand and a tube and fitting located within the vice grip.

Referring to FIG. 1, a locking hand vice 10 is shown having an immovable jaw 12 and a movable jaw 14, the position of which is controlled by a locking handle 16. The space between jaws 12 and 14 when in the closed position is controllable by an threaded adjuster 18 which moves lever arm 19 to determine the space between the jaws. When the handle 16 is compressed to a closed position it is releasable by exerting an outward force on locking mechanism 20. The features of a working vice grip in which a movable jaw and an immovable jaw are controlled by a mechanism such as shown by 16, 18, 19 and 20 are known in the art.

Shown in ghost in FIG. 1 is tube 22 and a hexagonal fitting 24 over which the hand vice 10 is to be secured in the following manner. On the immovable jaw 12, there are gripping surfaces 26*a*, and co-facially aligned gripping surfaces 26*b* on the movable jaw 14. The gripping services 26*a* and 26*b* together, when the jaws 12 and 14 are in a closed or substantially closed position, provide for surfaces for gripping the exterior of a tubular piece. Surfaces 26*a* and 26*b* may be serrated, roughened, or otherwise provided to grip to a smooth metallic surface. As shown in the embodiment of FIG. 1, the surfaces 26*a* and 26*b* contact tube 22 in a substantially tangential manner. Sufficient force is applied by the jaws through the surfaces 26*a* and 26*b* on tube 22 by adjusting the adjuster 18. When the jaw 14 is in a closed or substantially closed position movement of the tube 22 is prevented with respect to the fitting 24.

Still referring to FIG. 1, the jaws 12 and 14 are further provided with contacting surfaces 28*a* on the immovable jaw 12 and corresponding co-facial surfaces 28*b* on the movable jaw 14 which together (i.e., surfaces 28*a* and 28*b*) provide a hexagonally shaped securing means for securing the hexagonal fitting 24 when the movable jaw 14 is in a closed position.

Similarly, jaws 12 and 14 accommodate surfaces 30*a* (on the immovable jaw 12) and corresponding co-facial surfaces on the movable jaw 14 (not shown in FIG. 1) for accommodating a fitting having a smaller hexagonal head size. Preferably the surfaces 28*a* and 28*b* will accommodate the fitting of the female fitting and the surfaces 30*a* and corresponding surfaces 30*b* on the movable jaw will accommodate the hexagonal head of the male fitting.

Figure 2:
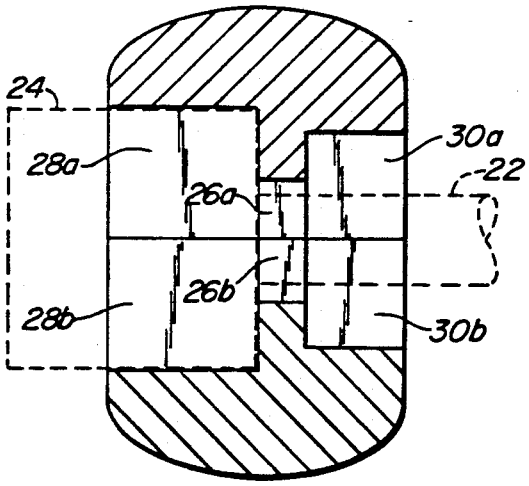
FIG. 2 is a cross sectional view through line A—A' of FIG. 1 of the jaws of a vice grip in a closed position holding tubing and one size of fitting.

Referring to FIG. 2 there is shown a cross-section of the jaws 12 and 14 from FIG. 1 taken from line A—A'. The jaws are shown in a closed position securing simultaneously the tube 22 through tangential contact with surfaces 26*a* and 26*b* and holding tube 22 in alignment with the female fitting 24, which in turn is secured against rotation by contact with surfaces 28*a* and 28*b*. As shown in FIG. 2, surfaces 30*a* and 30*b* are not being utilized.

Figure 3:
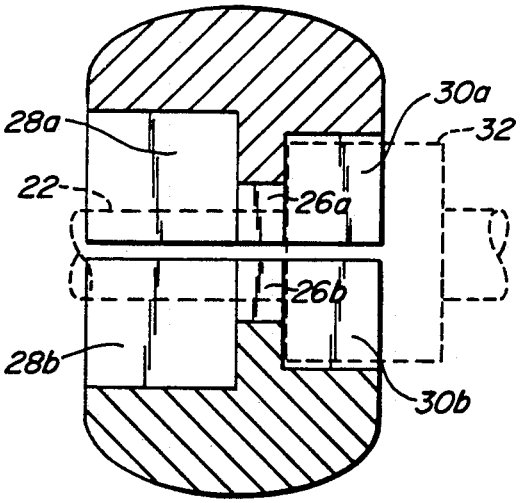
FIG. 3 is a cross sectional view of the vice grip along the line A—A' in FIG. 1 showing the jaws holding a tubing and a fitting of a different size.

Referring to FIG. 3 there is shown a cross section of the jaws through line A—A' wherein the surfaces of 30*a* and 30*b* are utilized to hold the hexagonal head of the male fitting 32 while simultaneously holding the tube 22 by tangential contact with surfaces 26*a* and 26*b*. As shown in FIG. 3 surfaces 28*a* and 28*b* are not in use.

It will be appreciated that various other embodiments and modifications of the preferred embodiment may be made without departing from the spirit and scope of the present invention. For example, instead of being smooth the surfaces 28*a* and 28*b* may be adapted with a locking mechanism for removable pieces which can be interchanged, each piece having a hexagonal or (other shape) orifice of different size shapes.

Also, the surfaces 26*a* and 26*b* which grip the tubular member 22 may be tooled, serrated, or other shape, as long as the shape is sufficient to secure a tubular member. It will also be realized that the surfaces 28*a*, 28*b*, 30*a* and 30*b* need not be defined within the body of the jaws 12 and 14 but instead they may be provided by flanges projecting from the surfaces of the jaws 12 and 14. This will accomplish the equivalent function of securing the fittings 24 and 32 while torque is being applied thereto during the tightening process.

The invention is not intended to be limited except by the scope of the following claims.

What is claimed is:

1. A double jawed locking hand vise comprising locking means for locking the jaws of said vise in a preselected closed position;

adjustment means for setting said closed position;

said jaws of said vise comprising co-facial surfaces having gripping means for securely holding a tubular piece therebetween;

a first securing means for securing a first nut of preselected size and shape against rotation with respect to said tubular piece held in said gripping means, a second securing means for alternatively securing a second nut of preselected size and shape against rotation with respect to said tubular piece held in said gripping means, said gripping means being concentrically disposed with said first or second nut, wherein each of said securing means comprises substantially planar surfaces angled with one another to accommodate said respective nut of preselected size and shape when said jaws are in a closed or a substantially closed position, to thereby prevent rotation of said respective nut with respective to said tubular piece.

2. A locking hand vice according to claim 1 wherein said securing means is removably attached to said jaws, and is interchangeable with other securing means adapted to accommodate nuts of different sizes and shapes.

3. A locking hand vice according to claim 1 wherein each of said gripping means comprises a co-facial serrated groove in each of said jaws, said grooves aligned with each other when said jaws are in a closed or substantially closed position, to thereby grip said tubular piece.

4. A locking hand vice according to claim 3 wherein each of said grooves comprises at least two planar surfaces angled with one another for substantially tangential contact with said tubular piece.

5. A locking hand device according to claim 1 wherein said substantially planar surfaces of said securing means are provided by flanges laterally extending from each of said jaws.

* * * * *